US005275483A

United States Patent [19]

Rasmussen

[11] Patent Number: 5,275,483

[45] Date of Patent: Jan. 4, 1994

[54] CENTER BOTTOM MOUNTED DRAWER SLIDE

[76] Inventor: Frank Rasmussen, 1214 Hwy. 143, Cedarburg, Wis. 53012

[21] Appl. No.: 7,393

[22] Filed: Jan. 21, 1993

Related U.S. Application Data

[63] Continuation-in-part of Ser. No. 927,894, Aug. 10, 1992, abandoned.

[51] Int. Cl.[5] ..... A47B 88/00

[52] U.S. Cl. ..... 312/334.41; 312/334.27; 312/334.44; 312/334.47

[58] Field of Search ..... 312/334.15, 334.19, 312/334.27, 334.31, 334.41, 334.44, 334.45, 334.46; 384/19

[56] References Cited

U.S. PATENT DOCUMENTS

| | | | |
|---|---|---|---|
| 2,139,520 | 12/1938 | Scheinman | 312/334.41 |
| 2,991,141 | 7/1961 | Houck | 312/334.41 |
| 3,649,086 | 3/1972 | Vance | 312/334.41 |
| 3,650,577 | 3/1972 | Gutner | 312/334.27 |
| 3,658,394 | 4/1972 | Gutner | 312/334.46 |
| 3,658,399 | 4/1972 | Vogt | 312/334.41 |
| 4,441,773 | 4/1984 | Leiper | 312/334.27 |
| 4,765,699 | 8/1988 | Bessinger | 312/334.46 |
| 4,881,826 | 11/1989 | Grass | 312/334.41 |

FOREIGN PATENT DOCUMENTS

| | | | |
|---|---|---|---|
| 620113 | 3/1949 | United Kingdom | 312/334.44 |

*Primary Examiner*—Peter M. Cuomo
*Assistant Examiner*—Flemming Saether
*Attorney, Agent, or Firm*—Wheeler Law Firm

[57] ABSTRACT

A bottom center mounted drawer slide mechanism for a drawer and cabinet. The mechanism is designed to be mounted along the bottom centerline of the drawer. The mechanism includes a cabinet track structure consisting essentially of a substantially C-shaped cross-section, rollers, and mounting tabs; a drawer track with retention dimples and rollers; a mounting plate onto which the drawer mounts; and a mounting unit which mounts onto the cabinet. The rollers of the cabinet track structure and the drawer track allow the drawer to move in and out smoothly and with little need for alignment adjustment.

3 Claims, 2 Drawing Sheets

CENTER BOTTOM MOUNTED DRAWER SLIDE

This application is a continuation-in-part of application Ser. No. 07/927,894 filed Aug. 10, 1992, now abandoned.

BACKGROUND OF THE INVENTION

The present invention relates generally to drawer slides and specifically to a bottom center mounted drawer slide. While many types of drawer slides are old and well known no drawer slide of the exact design proposed by the inventor is known.

The inventor knows of no prior art which discloses the present invention.

U.S. Pat. No. 4,659,237 discloses a concealed guide rail assembly and includes runner carriages which are guided on each side of the drawer between a respective supporting rail on the side of a furniture body and a pull out rail on the side of the drawer. The supporting rails have an upwardly open U-shaped profile with horizontally extending marginal flanges. The rollers of the runner carriages move on the upper side as well as the lower side of the supporting rails, i.e. in the U-shaped profile and at the marginal flanges. No runner carriage of the type disclosed in the present invention is taught or described by this patent. Nor does it teach the use of a structure for a center mounted drawer slide but rather it teaches the use of a concealed guide rail assembly for use on each of the opposite sides of an article of furniture for guiding movement of a member such as a drawer into and out of a furniture body.

U.S. Pat. No. 4,387,942 discloses a drawer slide assembly for supporting a drawer to slide open and close in an opening of a cabinet frame and includes an elongated upper member extending longitudinally of the drawer and secured to the drawer and a parallel lower member spaced below the upper member and secured to the frame. A pair of rollers are journaled side by side on the upper member near the rear thereof and engage track sections on the lower member. Similarly, a second pair of rollers are journaled on the lower member near the front thereof and these engage track sections formed on the upper member. The rollers are given a short axial profile while having effective diameters greater than their actual diameters by forming the rollers with surfaces that are inclined at acute angles relative to the roller axis. The associated track sections are inclined at similar angles. Each roller of the second pair of rollers is journaled by a plurality of bearing balls which are arranged so that the line of force of the load of the drawer is offset from the centers of the balls in a direction to produce a force which results in all of the balls supporting a portion of the load. This device is not the same as the device disclosed herein, and in particular, at least one of the rollers disclosed herein must always be frustoconical. Such a structure is not required by the present invention.

U.S. Pat. No. 3,649,086 discloses a drawer guide to provide noiseless, low friction operation of a drawer and is comprised of a channel shaped base member which is adapted to a fixed position in an article of furniture in order to extend centrally and longitudinally of the drawer in order to support the drawer. An inverted channel shaped slide member is adapted to be fixed to the bottom of the drawer and one of the members is telescoped within the other. A block of durable low friction material is extended centrally inside the outer member. The inner member has side walls terminating in turned-in flanges which extend into a groove on both sides of the block and which are also provided with ears of a durable low friction material that extend laterally from the side walls of the inner member and extend vertically beyond such turned in flanges into engagement with the outer members. The ears are located adjacent to one end of the assembly and the block is located adjacent to the other end of the assembly so that the drawer when closed is centrally supported at one end by the ears and at the other by the block. This is different in structure from the present invention.

U.S. Pat. No. 2,002,576 discloses a structure having upper slides which move parallel to each other in opposite directions by virtue of a reciprocating wheel 72 which when one side is moved in one direction causes the other side to move in the other direction. This is completely different in function and structure from the present invention.

U.S. Pat. No. 4,441,772 discloses a separable bottom mounted drawer slide and is characterized in that the slide assembly is provided with means for enabling the drawer to be removed and to be replaced with a minimum of manipulative effort. The slide assembly incorporates fail-safe features which assure that the assembly latching the drawer channel to the stationary channel is automatically shifted to a locked position responsive to assembly of the channels and is always in a position locked against accidental removal when the channels reach their mutually extended positions. Again this structure is not the same as the present invention.

U.S. Pat. No. 4,441,773 is chiefly important for disclosing a drawer slide assembly adapted to provide a secure connection between the drawer channel component of the assembly and the drawers having a wide depth. Again this structure is different from that of the present invention in both function as well as structure.

U.S. Pat. No. 3,981,553 discloses a drawer slide member having a C-shaped cross section installable on the underside of a drawer to co-act with an elongated dresser guide having a generally T-shaped cross section. The slide member has an elongated inwardly directed rib located on the vertical walls of the slide member. The ribs extend substantially over the length of the slide member and include additional inwardly directed ribs adjacent to the front end of the slide member. Again this structure is different from the present invention.

U.S. Pat. No. 3,797,906 discloses a drawer slide having a novel front panel connection. The essence of this invention is a channel shaped slide for the underside of a drawer having a fluted angle interior tab at its front end for securing the slide to a drawer having a hollow front panel. The structure is quite different from the present structure.

U.S. Pat. No. 3,365,261 discloses a slidable drawer structure.

U.S. Pat. No. 4,141,525 discloses a universal drawer slide mounting bracket for multiple positioning use with a drawer rail assembly that is a unitary member composed of a channel sleeve integral with an orifice mount plate along a linear junction. The mount plate includes a plurality of bend loci formed by the aligned orifices, one of which bend loci lies along a linear juncture and the others being normal thereto, with portions of the mount plate being formable along the bend loci in a multiplicity of directions. Again this is not the same as the present invention.

SUMMARY OF THE INVENTION

The present invention may be described as a bottom center mounted drawer slide mechanism for a drawer. The present invention is designed to be center mounted along the center line of the bottom of the drawer track. The drawer slide assembly consists essentially of a cabinet track structure that is substantially C-shaped in its widthwise cross section, four rollers, fasteners (usually screws) for attaching to the cabinet track structure, and an end mount support unit with mounting tabs for mounting the assembly to a cabinet. At least two of the rollers are affixed to the cabinet track structure with an axle. Mounting tabs are also attached to the cabinet track structure. The assembly further includes a drawer track having retention dimples. The other two rollers are attached to the end of the drawer track. The drawer track structure is capable of slidable engagement with the C-shaped cabinet track structure.

The rollers are spaced apart on each respective structure to facilitate slidable engagement. The retention dimples or stops on the drawer track structure provide a point for preventing slidable engagement of the two structures temporarily. The drawer track structure is capable of having a drawer mounted upon it. The slidable engagement structure enables the drawer to slide with minimal friction along a predetermined path. A positive stop on the cabinet track structure prevents the drawer track from fully sliding out of the cabinet track.

Accordingly, the present invention offers an improved drawer slide that may be used in a variety of drawers. The standard configuration for a drawer slide consists of mounting one set of slides on both sides of the bottom of the drawer. The present structure combines these features in a unique manner and mounts them under the center of the drawer. This makes assembly of the cabinet much more efficient; e.g. when the slides are mounted separately at the sides of the drawer bottom each one of the components must be mounted separately and the spacing between the components must be carefully maintained so that the slide mechanism does not jam. All components of the present invention remain in alignment because it is one structure.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 5:
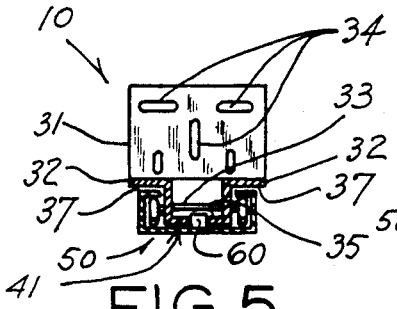
FIG. 5 is a cross-sectional end view of the invention showing the drawer track and cabinet track structures while engaged.
Figure 6:
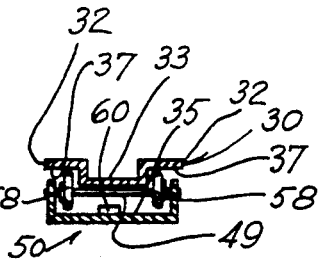
FIG. 6 is a cross-sectional end view of the invention showing the cabinet track structure.

The device of this invention is a drawer slide assembly 10 which may be seen in FIGS. 5 and 6 in a cross-sectional view.

Figure 1:
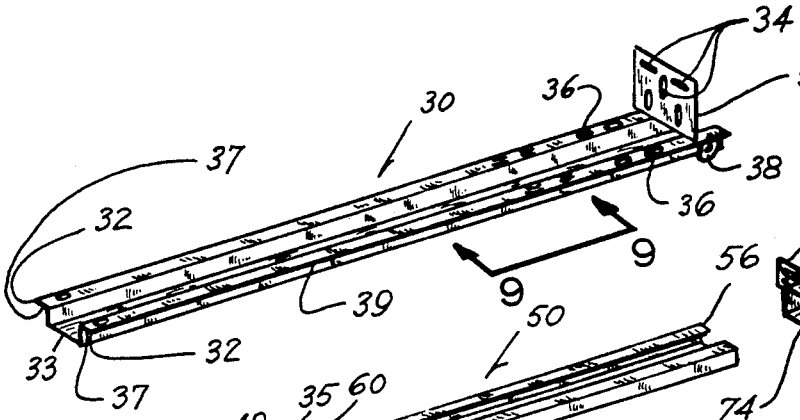
FIG. 1 is a perspective view showing the rigid drawer track structure.
Figure 3:
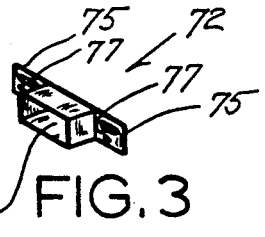
FIG. 3 shows an alternative end mount support unit for the cabinet track structure.
Figure 2:
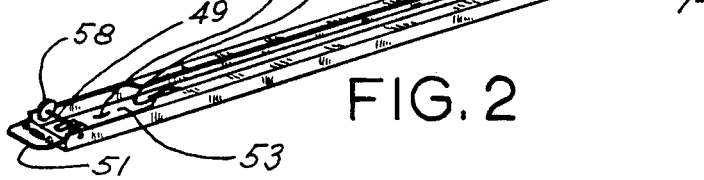
FIG. 2 is a perspective view showing the cabinet track structure.
Figure 9:
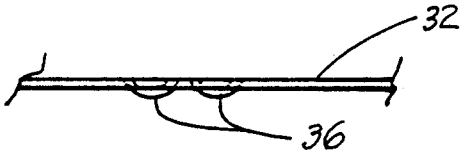
FIG. 9 is a view from line 9—9 of FIG. 1.
Figure 12:
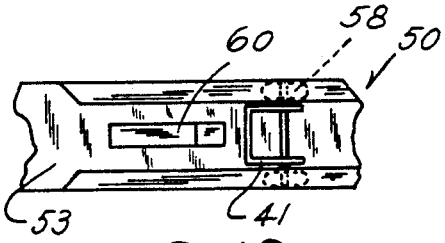
FIG. 12 is a top view of the positive stop, the drawer track rollers, and the axle housing.
Figure 13:
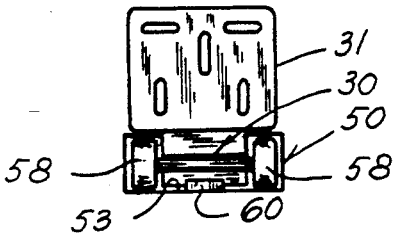
FIG. 13 is a cross-sectional end view of the invention.

Referring to FIGS. 1 through 3 the general structure of a drawer track 30 may be seen. The drawer track 30 affixes to the drawer 20. FIG. 1 discloses the drawer track 30 portion of the drawer slide assembly 10. The drawer track 30 comprises a mounting plate 31 having openings 34, two L-shaped members 32 integrally connected by cross-connection plate 33. Each L-shaped member 32 has a set of dimples 36 as shown in FIGS. 1 and 9. The drawer track 30 also has a set of rollers 38 mounted to it by an axle 40. As may be seen in FIG. 12, axle 40 is enclosed in axle housing 41, which may rotate freely around axle 40.

Figure 14:
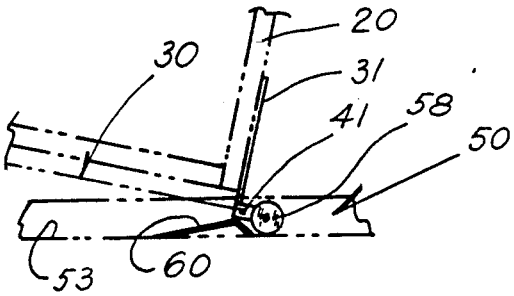
FIG. 14 is a right side view of the method of removing the drawer track from the cabinet track.

Referring to FIG. 14, it may be seen that the drawer track 30 and drawer 20 attached to drawer track 30 may be removed from the cabinet track 50 and the cabinet 21 by lifting front end 22 of drawer 20. This causes axle housing 41 to rotate over fulcrum 63 of positive stop 60, allowing removal of drawer 20 from cabinet 21. The gradual slope of long face 61 allows easy replacement of drawer 20 into cabinet 21.

Figure 10:
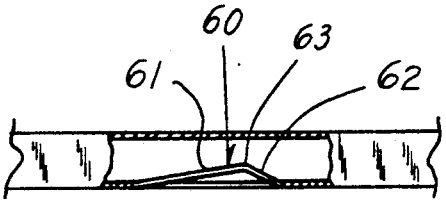
FIG. 10 is a right side view of the positive stop.
Figure 11A:
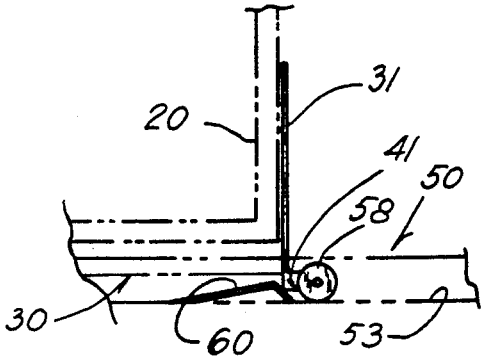
FIG. 11A is a right side view of the positive stop and drawer track in the stopped position.
Figure 11:
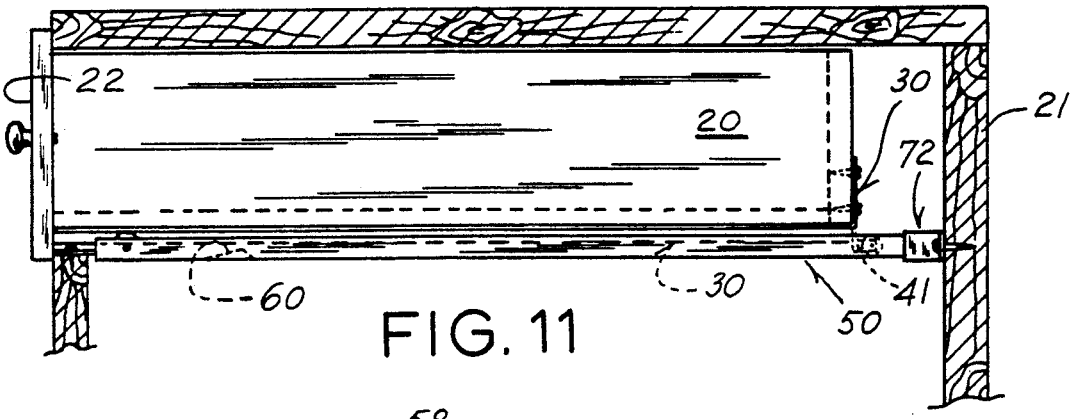
FIG. 11 is a right side view of the drawer slide, showing attachment to the drawer and cabinet.

Referring to FIG. 2 the cabinet track 50 of the drawer slide assembly 10 may be seen. The cabinet track 50 may be described as a track that is substantially C-shaped in cross-section as is shown in FIGS. 5 and 6. The cabinet track 50 comprises an end 56 for insertion into the end mount support unit 52 shown in FIG. 3A, rollers 58 attached to the cabinet track 50 by an axle 49, an opening 53 located near the rollers 58, a positive stop 60 located near the opening 53, and a mounting tab 51. As shown in FIG. 10, the positive stop 60 is ramp shaped with two faces, long face 61 and short face 62, meeting at fulcrum 63. Long face 61 slopes upward from bearing surface 35 toward end 56 of cabinet track 50, and then short face 62 slopes downward more steeply from fulcrum 63. Referring also to FIGS. 11A through 13, when drawer 20 opens enough so that roughly 80 percent of drawer track 30 has slidden out of cabinet track 50, axle housing 41 will strike short face 62 of positive stop 60, stopping motion of the drawer track 30 and drawer 20 attached to drawer track 30.

Figure 3A:
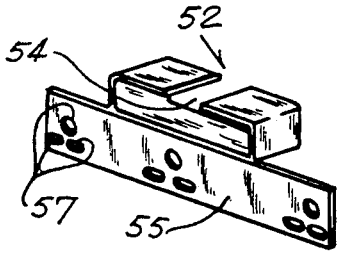
FIG. 3A shows an end mount support unit for the cabinet track structure.
Figure 7:
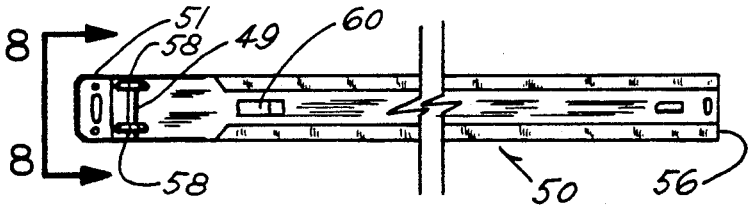
FIG. 7 is a top plan view showing the cabinet track with mounting tabs.
Figure 8:
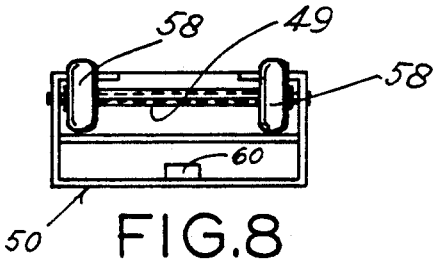
FIG. 8 is a view from line 8—8 of FIG. 7.

The end mount support unit 52 is disclosed in FIG. 3A and may be seen to comprise a mounting tab 55, openings 57 for receiving mounting or fastening means, and an opening 54 for receiving end 56 of the drawer track 50.

An alternative end mount support unit 72 is disclosed in FIG. 3 and may be seen to comprise two mounting tabs 75 having openings 77 for receiving mounting or fastening means, like screws 79, for mounting the end mount support unit 72 to cabinet 21, and an opening 74 for receiving end 56 of cabinet track 50.

Figure 4:
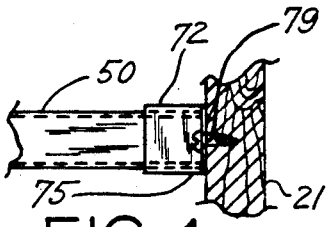
FIG. 4 is a side plan view showing one end of the cabinet track structure engaged with the end mount support unit.

The assembly 10 is put together as follows: the rollers 38 of the drawer track 30 are placed in end opening 53 so that they roll on bearing surface 35 of the cabinet track 50. The rollers 38 are then rolled toward end 56 on the drawer track 50 whereby that portion of the unit is assembled. The rollers 58 of the cabinet track 50 provide a bearing surface 39 for rolling friction which bears against the bottom surfaces 37 of the L-shaped members 32. In this manner there is the bearing surface 35 providing rolling friction on each portion of the drawer slide assembly 10 as it is moved. End 56 is inserted into the opening 54 of the end mount 52. The end mount 52 is then mounted to cabinet 21 as is shown in FIG. 4 using screws 79.

The dimples 36 of the drawer track 30 of the completed assembly 10 provide a temporary stop against which the rollers 58 will come into contact and thus prevent the drawer track 30 from being completely pulled out of the cabinet track 50 so that the drawer track 30 does not come crashing out of the opening 53 and off of its support assembly 10.

This unit 10 provides a centrally rigid structure which may be mounted beneath a drawer 20 as a single unit providing a simple and direct method of mounting the drawer track 30 and making unnecessary any complex measurements to determine if two separate side mounted drawer slides are in fact properly spaced level.

The above described embodiments of this invention are merely descriptive of its principles and are not to be limited. The scope of this invention instead shall be determined from the scope of the following claims, including their equivalents.

What is claimed is:

1. A bottom center mounted drawer slide mechanism for a cabinet and drawer, the bottom center mounted drawer slide mechanism consisting essentially of:

a drawer having a bottom, front, and back, and a centerline bisecting the drawer bottom;

a cabinet track structure that has a substantially C-shaped cross-section;

four rollers;

fastening means for attaching two of the rollers to the cabinet track structure;

a housing for the fastening means:

a mounting unit for mounting the mechanism to the cabinet;

mounting tabs being attached to the generally C-shaped structure;

a drawer slide assembly including at least two L-shaped rails having retention dimples;

two of the rollers being attached to the two L-shaped rails by a second fastening means;

the L-shaped rails being connected to each other by a cross connection structure which moves between the rollers on the cabinet track;

the drawer slide assembly being capable of slidable engagement with the C-shaped structure;

the drawer slide assembly being fastened to the drawer bottom along the centerline;

the rollers being spaced on each respective structure to facilitate the slidable engagement;

the retention dimples on the cabinet track structure providing a point for temporarily preventing slidable engagement of the two structures;

the drawer slide assembly being capable of having a drawer mounted upon it;

the slidable engagement structure enabling the drawer to slide with minimal friction along a predetermined path along the centerline of the drawer;

a positive stop on the cabinet track structure;

the positive stop engaging the second fastening means thereby preventing the drawer slide assembly from sliding out of the cabinet track structure unless the drawer front is lifted.

2. The bottom center mounted drawer slide mechanism of claim 1 in which the mounting unit has a single mounting tab and an opening above the mounting tab, whereby the mounting unit also serves as a support.

3. The bottom center mounted drawer slide mechanism of claim 1 in which the mounting unit has mounting tabs on either side of a central opening, whereby the mounting unit also serves as a support.

* * * * *